US005388782A

United States Patent [19]

King

[11] Patent Number: 5,388,782

[45] Date of Patent: Feb. 14, 1995

[54] APPARATUS FOR WINDING FENCE MATERIAL

[76] Inventor: Steven C. King, 216 Phelps Rd., Honeoye Falls, N.Y. 14472

[21] Appl. No.: 114,650

[22] Filed: Aug. 31, 1993

[51] Int. Cl.[6] ..... B65H 75/40

[52] U.S. Cl. ..... 242/557; 242/586.5

[58] Field of Search ..... 242/67.1 R, 86.5 R, 242/86.52, 86.7, 77, 77.3, 557

[56] References Cited

U.S. PATENT DOCUMENTS

| | | | |
|---|---|---|---|
| 1,215,454 | 2/1917 | Winchell | 242/86.5 R |
| 1,424,169 | 8/1922 | Koehring | 242/86.5 R |
| 2,616,636 | 11/1952 | Aden | 242/86.5 R |
| 2,839,257 | 6/1958 | Chicane | 242/86.5 R |
| 2,914,270 | 11/1959 | Parker et al. | 242/86.5 R |
| 3,045,936 | 7/1962 | Ruggeri | 242/86.5 R |
| 3,048,348 | 8/1962 | Griffin | 242/86.5 R |
| 3,632,054 | 1/1972 | Heppelmann | 242/86.5 R |
| 4,437,622 | 3/1984 | Heider | 242/86.5 R |
| 4,930,718 | 6/1990 | Lancour et al. | 242/86.5 R |
| 5,029,819 | 7/1991 | Kane | 256/24 |
| 5,163,634 | 11/1992 | Moon et al. | 242/86.5 R |

*Primary Examiner*—Stanley N. Gilreath
*Assistant Examiner*—John P. Darling
*Attorney, Agent, or Firm*—Howard J. Greenwald

[57] ABSTRACT

A device for winding fence material which contains a collapsible, rotatable drum comprising an internal hinge mechanism adapted to open or close such drum, a transverse slot within the drum adapted to secure such fence material, and a rotatable base upon which such drum is mounted.

13 Claims, 5 Drawing Sheets

FIG. 1
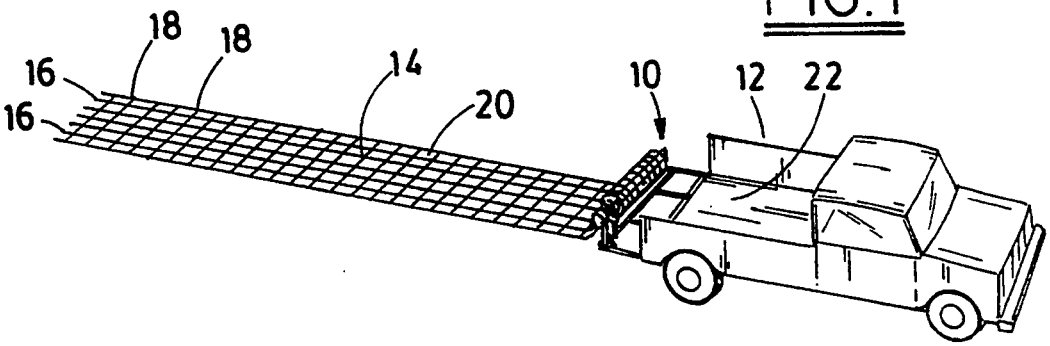
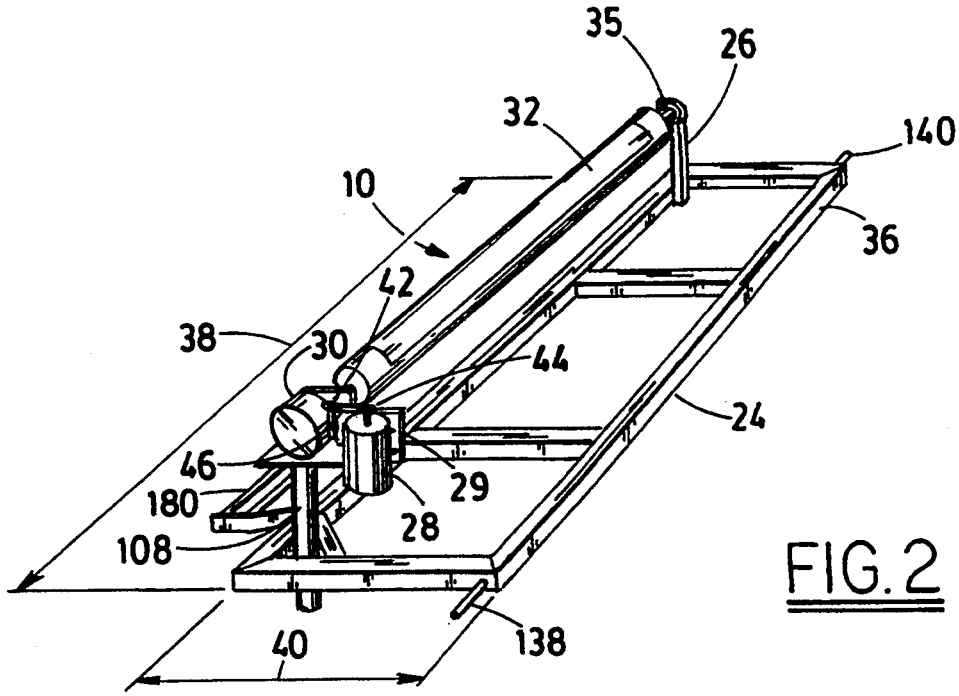
FIG. 2
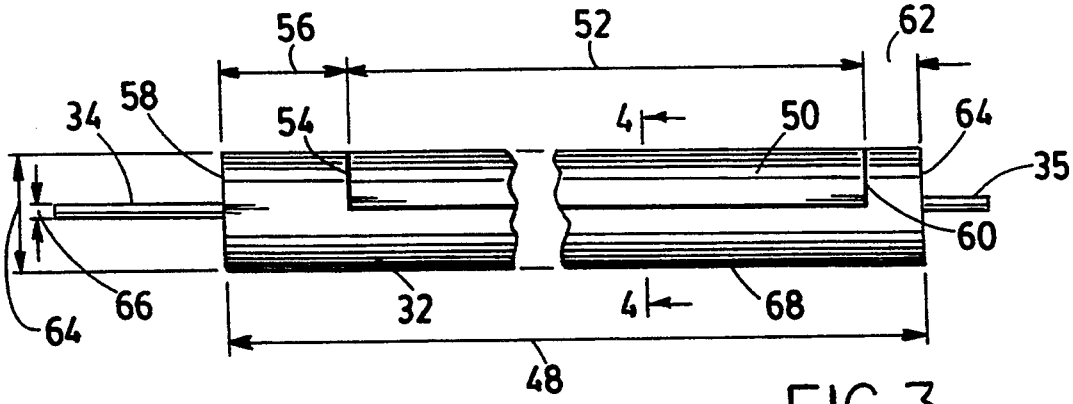
FIG. 3

APPARATUS FOR WINDING FENCE MATERIAL

FIELD OF THE INVENTION

An apparatus for winding and retrieving fence material (such as a snow fence, or safety fence) which contains a collapsible drum movably mounted on a support, and a means for rotating said drum.

BACKGROUND OF THE INVENTION

Snow fences are commonly used in the Northern part of the United States to control the spread of snow. They are usually put up in the Fall of the year in farmers' fields parallel to a road to be protected in order to prevent blowing snow from passing from such field to the road; and they are usually taken down in the Spring of the year.

These snow fences are difficult to put up, and to take down and store. Thus, as is disclosed in U.S. Pat. No. 2,914,270 of Parker et al., ". . . the labor of several persons is normally required inasmuch as the spool of wire is normally elongated heavy and bulky . . . The operation is tedious slow and extremely inefficient."

In the process of taking down and storing a snow fence, the fence is normally removed from the fence posts and laid flat on the ground; and thereafter it is rolled up in a circular mass.

The device of U.S. Pat. No. 2,914,270 is adapted to unwind a roll of fence when such fence is disposed vertically on a shaft. Even if such device could be modified to wind up a fence, it is not adapted to rotate a shaft which is disposed horizontally and substantially parallel to snow fencing laid flat on the ground. Thus, the device of this patent is not suitable for winding up snow fencing.

U.S. Pat. No. 5,029,819 of Kane describes a manually operated device for unwinding fencing material which is comprised of a crank 26, a shaft, and a chamber to which an end of the snow fence may be attached. The device of the Kane patent may only be operated when disposed vertically, and thus it is not suitable for rolling up fencing laying on the ground. Furthermore, no means is provided for removing a roll of the rolled up fence contained with the Kane device.

None of the prior art of which applicant is aware provides a motorized means for rolling up fence disposed on the ground.

None of the prior art of which applicant is aware provides a means for removing a roll of rolled-up fencing from a fencing winding device.

It is an object of this invention to provide a motorized apparatus for winding up fence material which is laying on the ground.

It is another object of this invention to provide an apparatus for winding up fence material which is comprised of a shaft/drum assembly rotating at a substantially constant rate.

It is another object of this invention to provide an apparatus for winding up fence material which is comprised of a collapsible drum.

It is another object of this invention to provide an apparatus for winding up fence material which allows the ready removal of the rolled up fence material from the drum.

SUMMARY OF THE INVENTION

In accordance with this invention, there is provided an apparatus for winding up fence material. This apparatus is comprised of a shaft, means for rotating said shaft at a specified rate, a collapsible drum attached to said shaft, means for securing fence material to said collapsible drum and rolling up said fence material, and means for removing rolled up fence material from said drum.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIG. 1 is a perspective view of the fence winding apparatus of this invention mounted on a pickup truck and winding up a snow fence.

FIG. 2 is perspective view of the fence winding apparatus of FIG. 1;

FIG. 3 is partial front view of the drum and shaft of FIG. 2;

DESCRIPTION OF THE PREFERRED EMBODIMENTS

Figure 4:
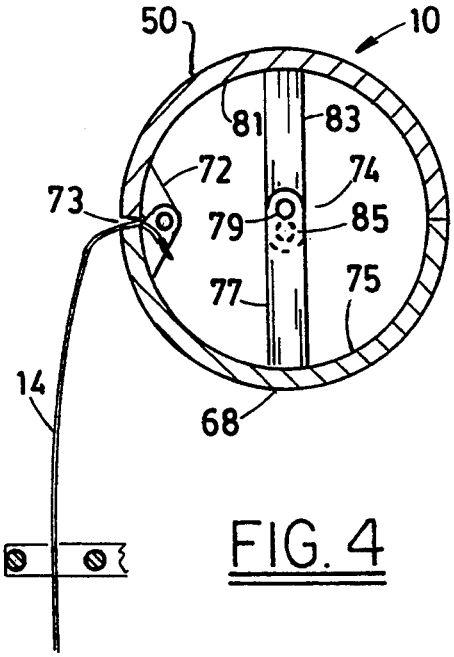
FIG. 4 is a sectional view of the drum of FIG. 3, taken along lines 4—4 and showing said drum in its closed position.

FIG. 1 is a perspective view of fence winding apparatus 10 mounted on truck 12 and in the process of winding up fencing material 14.

The fence winding apparatus of this invention may be used to wind substantially any flexible fence material 14.

As is known to those skilled in the art, a fence is a structure serving as an enclosure, barrier, or boundary. In the preferred process of this invention, the fencing material 14 used preferably is flexible and is comprised of a multiplicity of intersecting horizontal ribs 16 and vertical ribs 18 which, in combination, define a multiplicity of orifices 20. This type of fencing material 14 is widely commercially available. Thus, e.g., referring to page 1642 of the Grainger Fall 1193 General Catalog No. 384 (published by W. W. Grainger, Inc. of 430 West Metro Park, Rochester, N.Y.), one may purchase a diamond mesh safety fence made of high density polyethylene with a mesh opening of 1.5 inches (catalog number 5W418), and/or a warning barrier fence made of high density polyethylene with an oval mesh opening of 2.5"×0.8" (catalog number 5T587).

In one embodiment, the fencing material 14 is adapted for use as a snow fence and/or as a sand fence. These type fences are well known to those skilled in the art and are described, e.g., in U.S. Pat. Nos. 4,958,806, 4,932,634 (plastic slot snow fence), 4,848,386, 3,966,172, 3,913,889, 3,672,638, 3,630,489, and the like. The disclosure of each of these United States patents is hereby incorporated by reference into this specification.

In one embodiment, the fencing material 14 is a safety fence. These type of fences are disclosed in U.S. Pat. Nos. 5,039,066, 4,930,752 (highway fencing), 5,830,341, 4,787,475, 4,143,857, 3,912,061, 3,733,054, 3,567,184, and 3,439,898. The disclosure of each of these patents is hereby incorporated by reference into this specification.

In one preferred embodiment, fencing material 14 consists essentially of plastic. Plastic fences are disclosed, e.g., in U.S. Pat. Nos. 4,722,514, 4,684,107, 4,553,741, and 4,477,058, the disclosure of each of which is hereby incorporated by reference into this specification.

In one preferred embodiment, the fencing material 14 is a flexible wood fence.

In the remainder of this specification, reference will be made to the use of applicants apparatus 10 with regard to a plastic fence, it being understood that other fencing materials also may be used with such apparatus.

Referring again to FIG. 1, it will be seen that winding apparatus 10 is mounted on a pickup truck 12. It will be apparent to those skilled in the art that that any movable structure may be used to mount device 10. Thus, by way of illustration and not limitation, one may use a horse-drawn wagon, a tractor, a backhoe, and the like. As long as the structure has enough integrity to support the device 10, and as long as the structure preferably is movable, it may be used with device 10.

In one preferred embodiment, structure 12 is a pickup truck with a bed 22 on which the structure 10 is mounted. Any conventional means may be used to mount the structure 10 to the bed 22. Thus, e.g., one may clamp the device to the bed 22, one may secure it with fasteners (such as bolts), one may secure the device 10 with a chain, etc.

FIG. 2 is a perspective view of the preferred winding apparatus 10. Referring to FIG. 2, it will be seen that winding device 10 is comprised of a frame 24, an end shaft support 26, a motor 28, a speed reducer 30, a drum 32, and a shaft 34.

Referring again to FIG. 2, it will be seen that, in the preferred embodiment illustrated therein, frame 24 is preferably rectangular and is preferably made from square steel tubing (1.5"×1.5"×3/16") which is then welded together to provide the desired rectangular structure.

One may obtain square steel tubing (or other steel tubing) from many commercial sources. Thus, e.g., referring to the page 9 of the "1993 Stock List" of the Klein Steel Service, Inc. of 961 Lyell Avenue, Rochester, N.Y. 14606, one may purchase square tubing ranging from ½"×16 gauge to 8"×¼ gauge.

Referring again to FIG. 2, it will be seen that the frame 24 may have a length 38 of at least about 74 inches and preferably from about 74 to about 80 inches. In this embodiment, the width 40 of frame 24 is from about 15 to about 22 inches and, preferably, is from about 19 to about 21 inches.

Referring again to FIG. 2, it will be seen that the winding apparatus 10 is comprised of a motor 28 which which, prefrably is an direct current electric motor. In one preferred embodiment, motor 28 is a direct current electric motor rated at at least about 0.33 horsepower and, preferably, at least about 0.5 horsepower.

Direct current electric motors are well known to those skilled in the art and may be purchased, e.g., from Pacific Scientific Company, Motor and Control Division, 4301 Kishwaukee Street, Rockford, Ill. Reference may be had to the Pacific Scientific catalog JT91297 which was printed in June of 1992. At pages 6–7 of this catalog, low voltage electirc motors are described. Some of these motors operate at 12 volts direct current, and they are rated from 0.125 to about 0.5 horsepower; others of these motors operate at 24 volts direct current, and they are rated from 0.125 to 1 horsepower.

In one preferred embodiment, one may use Pacific Scientific catalog numbers BA3630-7006-9-48B, or catalog number BA3638=4588-9-48B, both of which are rated at 0.5 horsepower and operate at 12 volts direct current. These motors may be purchased from a distributor such as, e.g., Vordex, Inc. of 833 Phillips Road, Victor, N.Y.

In one embodiment, it is preferred that the shaft 34 be caused to rotate at a speed of from about 20 to about 50 revolutions per minute. It is more preferred that the shaft 34 be caused to rotate at a speeed of from 30 to about 40 revolutions per minute. In an even more preferred embodiment, the shaft 34 is caused to rotate at a speed of from about 33 to about 37 revolutions per minute. In the most preferred embodiment, the shaft 34 is caused to rotate at a speed of about 35 revolutions per minute.

As will be apparent to those skilled in the art, as the fencing material 14 is rolled up onto drum 32, the weight of material on drum 32 increases, and the amount of force required to rotate drum 32 increases. If a means for rotating shaft 34 has a substantially constant output, it will rotate the drum 32 at a slower rate when it is loaded with all of the fencing material 14 than when it is unloaded with such material.

It is preferred to rotate the shaft 32 and the drum 34 so that, during the period of operation, the drum will rotate at a speed of less than about 41 revolutions per minute and, preferably, from about 30 to about 40 revolutions per minute.

In one preferred embodiment, illustrated in FIG. 2, the output from motor 28 (which often is in excess of 1,000 reovlutions per minute) is reduced to a more suitable rate of revolution by speed reducer 30.

As is known to those skilled in the art, precision speed reducers are readily commercially available. Thus, e.g., one may obtain such speed reducers from the Ailing-Lander Division of the Regal-Beloit Coropration, 1524 15th Avenue, Union Grove, Wis. Thus, by way of illustration, one may use the "Style Y" speed reducer illustrated on page 4 of such catalog, which has a male input and a female output. In one embodiment, this Style Y is used at a ratio of 50/1 (see page 8 of the catalog. As will apparent to those skilled in the art, if one knows the output of the electric motor used, and the rate of revolution of said motor, and the desired rate of revolution of the output shaft 34, by referring to the table on page 8 of such Ailing-Lander catalog, one may determine precisely which model of speed reducer will give one the desired output.

Referring again to FIG. 2, it will be seen that motor 28 and speed reducer 30 are connected by pulley 42, pulley 44, and V-belt 46. As will be apparent to those skilled in the art, other means for connecting motor 28 and speed reducer 30 also may be used.

FIG. 3 is a partial front view of drum 32 mounted on shaft 34. In the preferred embodiment illustrated in FIG. 3, drum 32 has certain dimensions which are important for its proper operation.

Referring to FIG. 3, it will be seen that the length 48 of drum 32 is preferably at least about 57 inches and, more preferably, at least about 60 inches. It is preferred that length 48 not exceed 65 inches.

Figure 5:
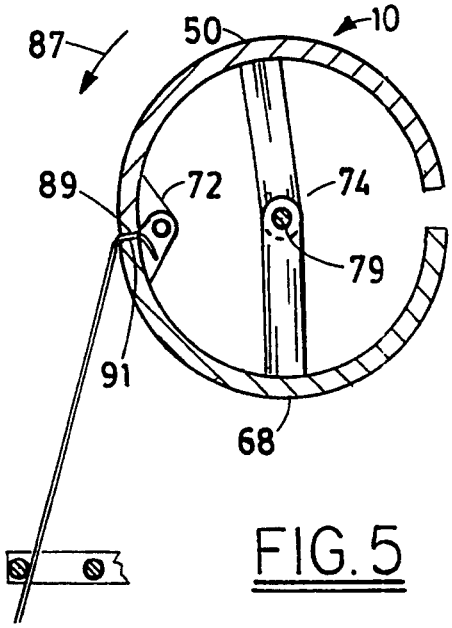
FIG. 5 is a sectional view of the drum of FIG. 3 in its open position.

Referring again to FIG. 3, it will be seen that drum 32 is comprised of a movable door 50, which is illustrated in greater detail in FIGS. 4 and 5. In one embodiment, not shown, movable door 50 extends the entire length of drum 32. In the preferred embodiment illustrated in FIG. 3, movable door 50 extends a length 52 which preferably is less than the length 48 of drum 32 and often is at least about 48 inches, and more, preferably, from about 50 to about 52 inches.

In the preferred embodiment illustrated in FIG. 3, the proximal end 54 of movable door 50 is disposed at a distance 56 from the end 58 of drum 32 which is at least about 6 inches and, preferably, is from about 7 to about 12 inches. The distal end 60 of movabler door 50 is disposed at a distance 62 from the end 64 of drum 32 which is at least about 1.5 inches and, preferably, is from about 2 to about 3 inches.

Referring again to FIG. 3, it will be seen tha drum 32 has a diameter 64 of at least about 3.5 inches and, preferably, from about 4 to about 4.5 inches.

The shaft 34 preferably has a diameter of at least about 0.75 inches and, more preferably, from about 1 to about 1.5 inches. The shaft 34 preferably consists of cold rolled steel and may be purchased, e.g., from said Klein Steel Service, Inc. catalog; see, e.g., page 12 of such catalog.

The movable door/drum assembly may be constructed by conventional means. Thus, by way of illustration, one may start with a steel pipe with a length 48 and, by means of a suitable saw, cut an arcuate section out of such pipe. Thereafter, one may hingably attach the arcuate section to the pipe to produce the movable door 50.

Referring to FIGS. 4 and 5, and to the discussion in the preceding paragraph, the steel pipe used may be steel pipe 68; and the section cut from the steel pipe 68 may be removable door 50. After removable door 50 has been cut from pipe 68, it may be hingably attached to pipe 68 by means of hinge 72. One may use any conventional hinge as hinge 72 such as, e.g., a 4" Stanley door hinge which may be purchased in any hardware store.

Referring again to FIG. 4, fencing material 14 is disposed within a slot 73 located between steel pipe 68 and movable door 50. In this position, the fencing material can readily be dislodged from the slot 73.

Connected to the interior wall 75 of steel pipe 68 is a locking bar 77 comprised of orifice 79. Connected to the interior wall 81 of movable door 50 is a locking bar 83 comprised of orifice 85. In the closed positon illustrated in FIG. 4, orifices 79 and 85 are not congruent with each other; and a rod (not shown) is unable to pass through both of such orifices at the same time.

By comparison, and referring to FIG. 5, when movable door 50 is rotated in the direction of arrow 87, three distinct things happen. In the first place, fencing material 14 is securely clamped within slot 73, as end 89 of movable door 50 is moved towards end 91 of steel pipe 68. In the second place, the effective diameter of the shape formed by movable door 50 and steel pipe 68 increases. In the third place, as illustrated in FIG. 5, orifices 79 and 85 become aligned with each other, allowing a locking rod (not shown) to be inserted therethrough.

Figure 6:
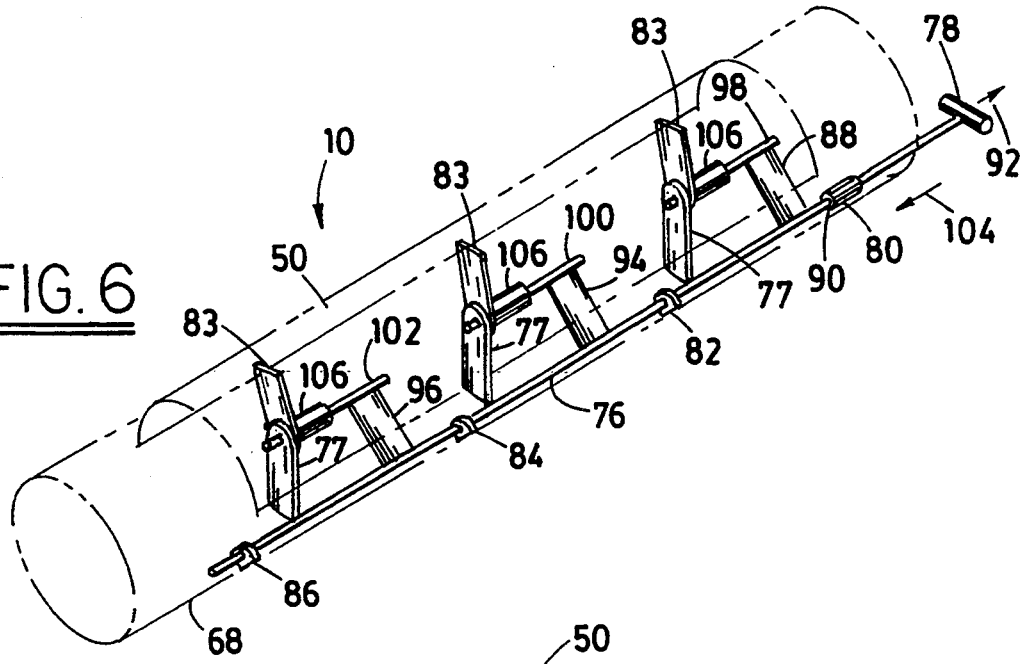
FIG. 6 is an exploded view of the locking device of the drum of FIG. 3.

FIG. 6 illustrates one means of locking the winding assembly 10 into the position depicted in FIG. 5. In the preferred embodiment illustrated in FIG. 6, a movable rod 76 attached to a handle 78 passes through guides 80, 82, 84, and 86 which, preferably, are attached to the inner wall 75 of steel pipe 68.

Rod 76 is connected to flap 88 which is substantially aligned with the front surface 90 of stop 80. When handle 78 is pulled in the direction of arrow 92, the degree to which rod 76 may travel in the direction of arrow 92 is limited as flap 80 contacts front surface 90.

Rod 76 is also connected to flaps 94 and 96. Each of flaps 88, 94, and 96 is connected to a corresponding rod 98, 100 and 102. Thus, when rod 76 is pushed in the direction of arrow 104, and when orifices 79 and 85 are aligned (see FIG. 5), the rods 98, 100, and 102 can be pushed through the orifices 79 and 85 and, when so pushed through these orifices, will lock the assembly 10 in the position depicted in FIG. 5. In such locked position, the fencing material 14 is securely held in place by being clamped within slot 73.

Figure 7:
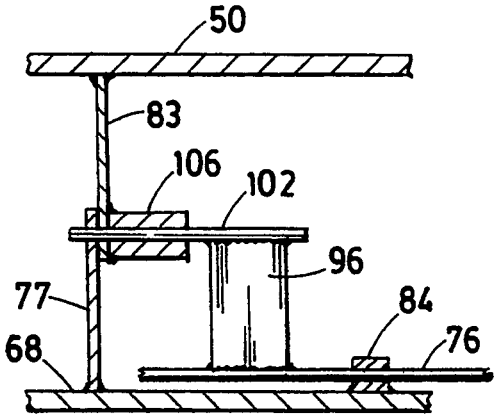
FIG. 7 is a sectional view of the locking device of FIG. 6.

FIG. 7 is an exploded cross-sectional view of the assembly of FIG. 6. Referring to FIG. 7, it will be seen that, in the preferred embodiment illustrated in FIGS. 6 and 7, an alignment cylinder is attached to locking member 83 and provides positive alignment for rod 102 through such cylinder and through orifices 85 and 79.

As will be apparent to those skilled in the art, when fencing material 14 is being rolled up onto drum 32 (and onto the movable door 50 section thereof), the drum 32 is in the expanded position depicted in FIG. 5. After the entire section of fencing material 14 has been rolled up, and preferably tied, handle 78 may be pulled in the directin of arrow 92, thereby causing movable door 50 to collapse to the position depicted in FIG. 4, to increase the width of slot 73, and to decrease the effective diameter of the movable door 50 section of drum 32. This allows the ready removal of the rolled up fencing material (not shown) from the collapsed drum 32.

Figure 8:
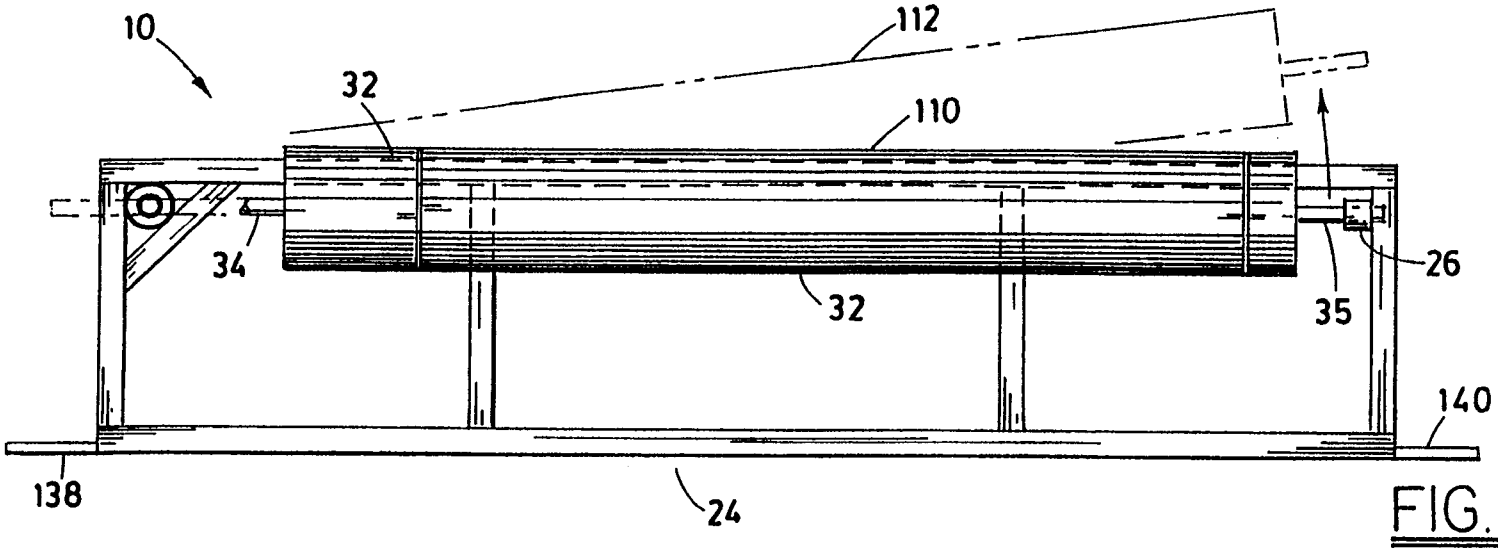
FIG. 8 is a top view of the apparatus of FIG. 2.

FIG. 8 is a top view of apparatus 10, showing that drum 32 is hingably attached to pivot assembly 108 and, thus, may be moved from position 110 to position 112. After the fencing material 14 has been rolled up onto the drum 32, the shaft 35 may be removed from end shaft support 26 (see FIG. 8), the drum may be moved to position 112, and the rolled up fencing material 14 may then be removed from the collapsed drum.

Figure 9:
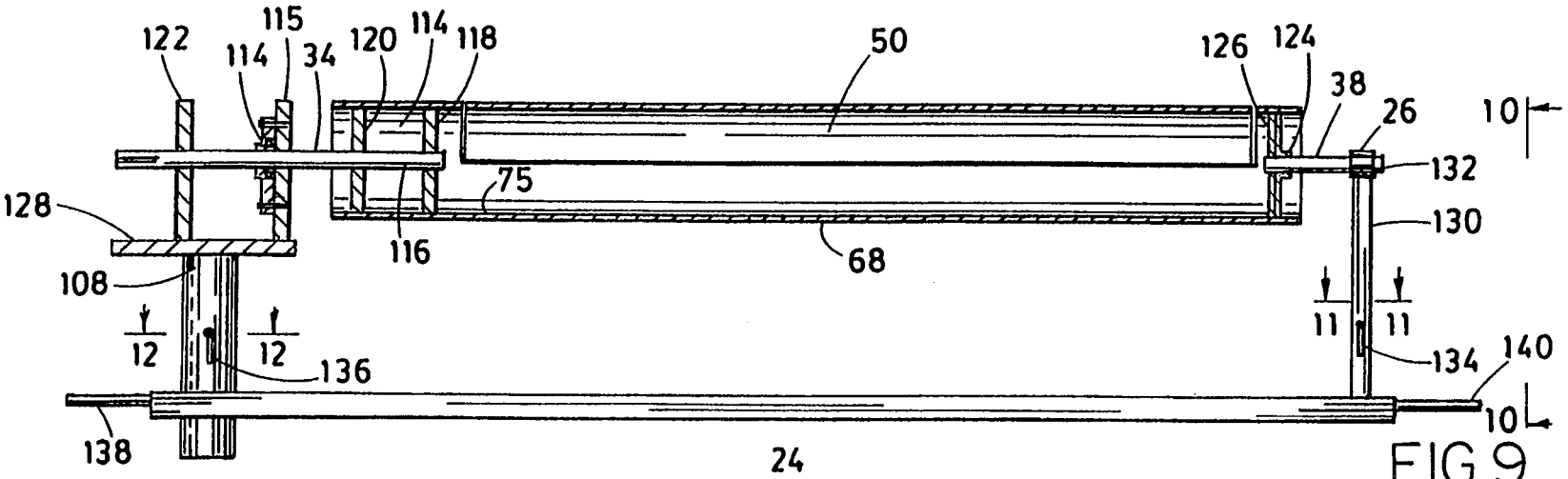
FIG. 9 is a sectional view of the apparatus of FIG. 8.

FIG. 9 is a sectional view of the assembly of FIG. from which details relating to the motor 28 and the speed reducer 30 have been omitted for the sake of simplicity. In the preferred embodiment illustrated therein, shaft 34 is preferably connected to bearing 114 which, in one preferred embodiment, is a 1 inch flange mount (4-bolt) VF4S bearing sold by the aforementioned W. W. Grainger, Inc. company (see page 261 of the aforementioned Grainger catalog); bearing 114 is connected to bearing plate 115. The distal end 116 of shaft 34 is diposed within drum 32 and connected to said drum by means of gussets 118 and 120 which are welded to the interior wall 75 of the drum 32. The shaft 34 also is disposed within an orifice (not shown) in speed reducer mounting plate 122. Both bearing plate 115 and speed reducer mounting plate 122 are preferably supported on and attached to base plate 128.

Referring again to FIG. 9, end shaft support assembly 26 is comprised of support member 130 which is connected to cradle 132. Support member may be constructed of any conventional material such as, e.g., square metal tubing. One may thus use, e.g., 1.5"×1.5" square tubing with a wall thickness of 3/16".

A locking handle 134 is disposed on support member 130. This handle 134 is shown in greater detail in FIG. 11.

Referring again to FIG. 9, a locking handle 136 is disposed on pivot assembly 108. This assembly is shown in greater detail in FIG. 12. Shaft 35, which may have substantially the same radius as shaft 34, is disposed within end shaft support 26 and is movably connected to bearing 124, which also is attached to the interior wall 75 of drum 32; in the embodiment illustrated, shaft 35 is preferably comprised of hollow steel pipe; by comparison, shaft 34 consists essentially of solid steel and has a different length. Additionally, shaft 35 is connected to gusset 126 which, in a manner similar to gussets 118 and 120, is connected to the interior of drum 32.

Referring to FIG. 2, and also to FIGS. 8 and 9, connected to frame 24 are mounting pins 138 and 140 which may be used to secure the frame to a base such as, e.g., the bed of a pickup truck. Thus, referring to FIG. 1, in this embodiment the tailgate (not shown) of truck 12 has been removed, and the mounting pins 138 and 140 (not shown in FIG. 1) have been inserted in the tailgate locking mechanism and clamped in place. One may also secure apparatus 10 by a chain (not shown) connected around frame 24 and secured to the upper body of the pickup truck.

Figure 10:
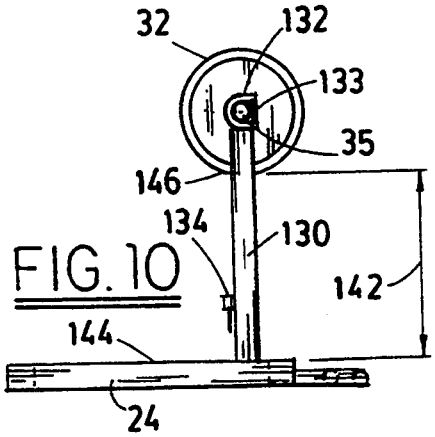
FIG. 10 is a sectional view of the apparatus of FIG. 9, taken through lines 10—10.

FIG. 10 is an end view of the embodiment depicted in FIG. 9. Referring to FIG. 10, and also to FIG. 11, it will be seen that the distance between the top 144 of frame 24 and the bottom 146 of drum 32 may be increased or decreased to accommodate rolled up fencing 14 (not shown) of different thicknesses. In a similar manner, as shown in FIGS. 10 and 12, the effective length of pivot assembly 108 also may be varied.

Referring again to FIG. 10, and to the preferred embodiment depicted therein, a removable locking pin 133 is disposed within cradle 132 so that, during the operation of the winding device 10, the shaft 35 is securely disposed within said cradle. After such operation, the locking pin 133 may be removed, and the shaft 35 may be disengaged from cradle 132.

Figure 11:
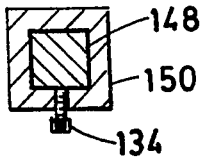
FIG. 11 is sectional view of the end shaft support means of FIG. 9, taken through lines 11—11.
Figure 12:
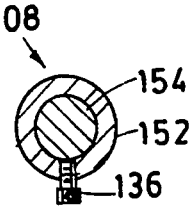
FIG. 12 is a sectional view of the pivot means of FIG. 9, taken through lines 12—12.

Referring to FIG. 11, which is a sectional view of support member 130 taken along lines 11—11, it will be seen that such support member is comprised of a first length 148 of square tubing which is connected to frame 24 and is disposed within a second length 150; second length of square tubing 150 is connected to cradle 132. By moving the second square tubing 150 up and down to its desired height, and securing it with locking handle 134, one may adjust the effective height of that end of the drum 32 and shaft 35 which is removably connected to cradle 132.

In the embodiment illustrated in FIG. 11, locking handle 134 is a bolt which extends through a threaded orifice (not shown) and which may be tightened in place whenever square tubing 150 has been adjusted to its desired length.

A similar arrangement may be used to adjust the height of member 108. Referring to FIG. 12, pivot assembly 108 is comprised of a first tubular member 152 which is welded to frame 24 within corner 153 and is also welded to member 155.

Disposed within first tubular member 152 is solid shaft 154, which is welded to the underside of base plate 128.

As will be apparent to those skilled in the art, one may change the relative positions of members 152 and 154 after loosening locking assembly. One may raise or lower the member 154, thereby increasing or decreasing the effective height of base plate 128. Alternatively, or additionally, one may, after removing shaft 35 from cradle 132 (see FIGS. 13 and 14), rotate solid shaft 154 within member 152.

It is often desirable to rotate the shaft 154, and the drum assembly indirectly connected to it, once a rolled up roll 156 of fencing material 14 has been prepared. Once such roll 156 has been prepared, it is preferred to secure it by suitable means such as, e.g., wire ties 158 and 160. Thereafter, one may loosen locking member 136, remove shaft 35 from cradle 132, rotate roll 156 to position depicted in FIG. 13, and then prepare to collapse the drum 32.

Figure 13:
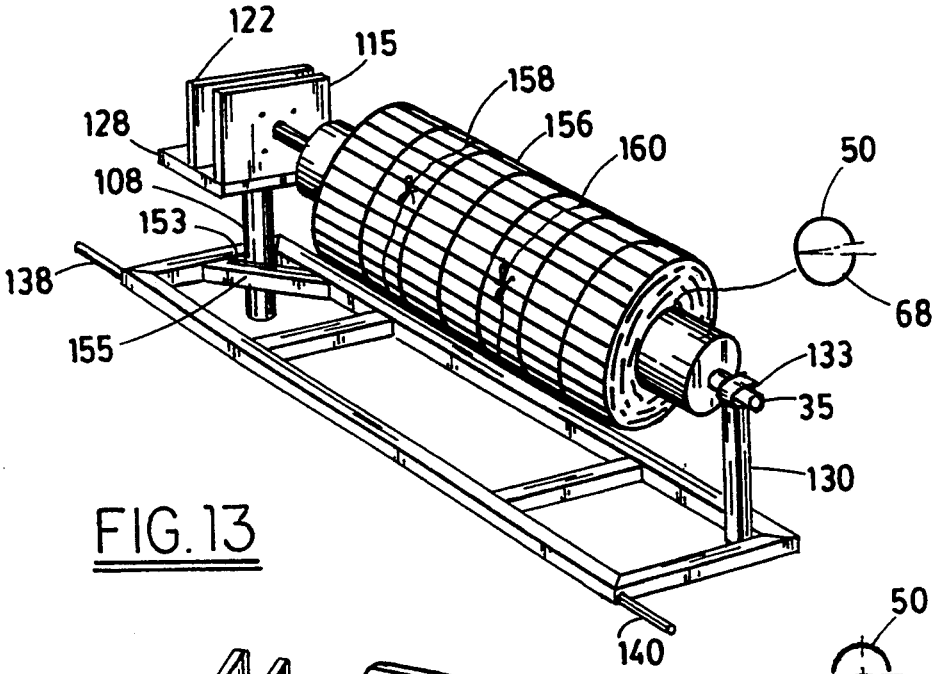
FIG. 13 is a perspective view of a roll of snow fence rolled upon on the apparatus of FIG. 3.

In the position illustrated in FIGS. 13 and 5, the drum 32 is in its open, expanded position. However, once the drum 32 has been rotated to the position depicted in FIG. 14, one may pull knob 78 in the direction of arrow 92 (see FIG. 6) and cause locking pins 98, 100, and 102 to disengage from orifices 79 and 85 (see FIGS. 4, 5, and 6), thereby causing locking bars 77 and 83 to fall out of alignment and also causing movable door 50 to shut.

Referring again to FIG. 6, it is preferred that, when movable door 50 is collapsed (as shown in FIG. 4), it will either be flush with steel pipe 68 (forming a substantially perfect cylinder therewith) or, alternatively, fall below the surface of pipe 68.

Referring again to FIG. 13, in the embodiment depicted herein, the movable door is substantially flush with steel pipe 68, and the rolled up fencing (which has an internal diameter which now exceeds the external diameter of the drum 32) may be readily removed from drum 32 by pulling it in the direction of arrow 162.

Figure 15:
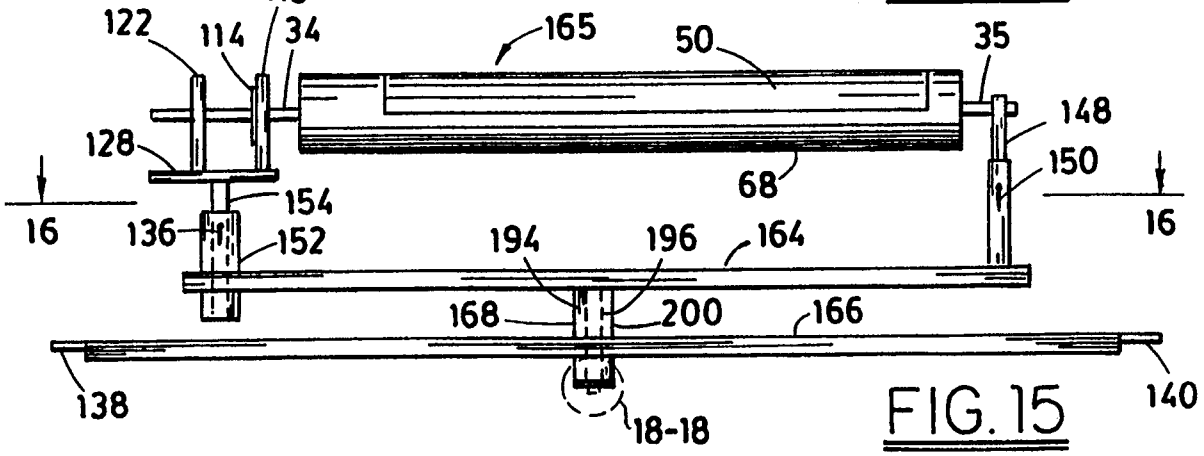
FIG. 15 is a front view of another embodiment of the fence unwinding apparatus of this invention.

FIG. 15 is a front view of another preferred embodiment 165 of applicant's invention in which frame member 164 is pivotally attached to base 166 by means of frame pivot 168.

Figure 16:
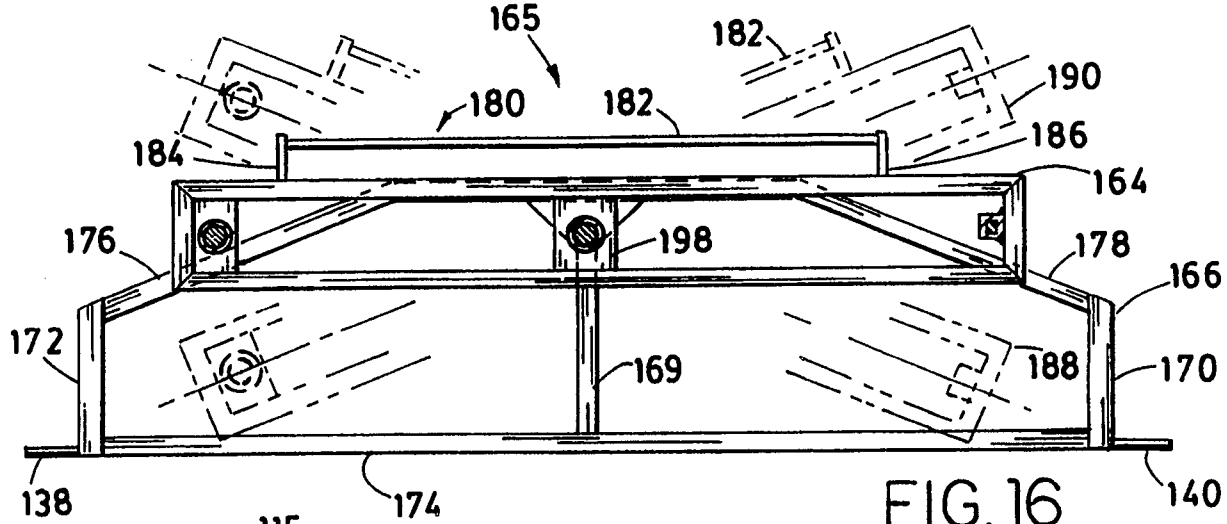
FIG. 16 is sectional view of the frame of the embodiment of FIG. 15, taken through lines 16—16.

FIG. 16 is a top view of device 165. Referring to FIG. 16, it will be seen that pivoting frame member 164 is pivotally attached to frame 166. Frame 166 is comprised of frame members 169, 170, 172, 174, 176, and 178. Attached to pivoting frame member 164 is front alignment roller 180

Referring to FIG. 16, it will be seen that front alignment roller 180 is comprised of a shaft 182 rotabably mounted within pins 184 and 186. The fencing material 14 may be fed in between shaft 182 and frame member 164, and the assembly 180 will help guide and feed the fencing material onto the drum 32 during the operation of the device 10.

Referring again to FIG. 16, it will be seen that, because of the pivotal mounting of member 164, it can be rotated to a variety of positions, including positions 188 and 190.

Figure 18:
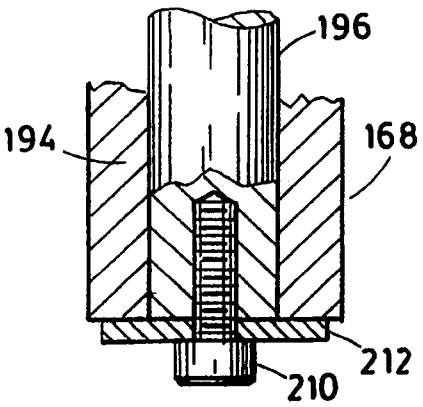
FIG. 18 is a partially broken away view of the pivot of the device of FIG. 15.

FIG. 18 is a front view, partially broken away, of frame pivot 168. Referring to FIG. 18, it will be seen that frame pivot 168 is comprised of an outer shaft 194 and an inner shaft 196 disposed therein. Inner shaft 196 is connected to swivel plate 198 of member 164 and, when not locked in place by locking member 200 (which may be similar in configuration to locking member 134, and/or locking member 136) is free to rotate within outer shaft 194. Locking tabs (not shown) are welded to the outer shaft 194 and the underside of plate 198 to permit limited rotation.

FIG. 18 illustrates a preferred embodiment of pivot member 168 which is comprised of bolt 210 and washer 212 which cooperate to retain the assembly together.

Figure 17:
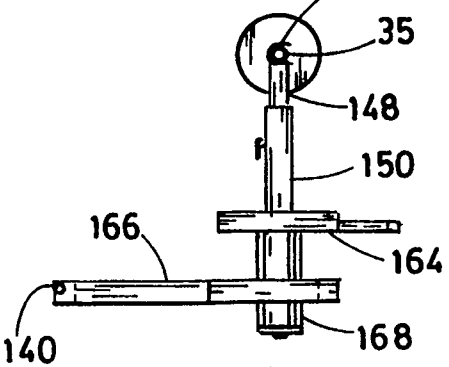
FIG. 17 is a front view of the end shaft support of the device of FIG. 15.

FIG. 17 is an end view of the embodiment of FIG. 15

The following example is presented to illustrate the claimed invention but is not to be deemed limitative thereof.

Example

An unwinding apparatus 165 configured substantially in accordance with the embodiment illustrated in FIGS. 15–18 was produced. Referring to FIG. 3, the drum 32 had a length 60 inches and a diameter of 4.5 inches. The movable door 50 had a length of 51 inches and was located 7 inches from the left side of the drum 32 and 2 inches from the right side of drum 32. The movable door was cut from a steel pipe so that it had an arc length substantially equal to the arc length of the steel pipe which remained.

The shaft 34 used was a solid, 1" diameter steel rod. The shaft 35 was a 1" diameter steel pipe with a wall thickness of 3/16".

The motor was 0.5 horsepower direct current motor which was mounted to a motor plate 29 (see FIG. 2) comprised of a multiplicity of mounting holes which allowed the motor to be moved to different positions.

The fencing material to be taken up was laid out in 100 foot length. It consisted essentially of high density polyethylene.

Locking handle 200 was loosened (see FIG. 15), and the upper frame 164 was rotated until it was substantially parallel with the edge of the fencing material.

The edge of the fencing material was passed between roller 182 (see FIG. 16) and frame 164. The edge of the fencing material was then inserted into slot 73 (see FIG. 4), and the movable door 50 was then manually opened, thereby clamping the fencing material within such slot. Thereafter, handle 78 (see FIG. 6) was pushed inwardly, locking the movable door 50 in the open position.

Figure 14:
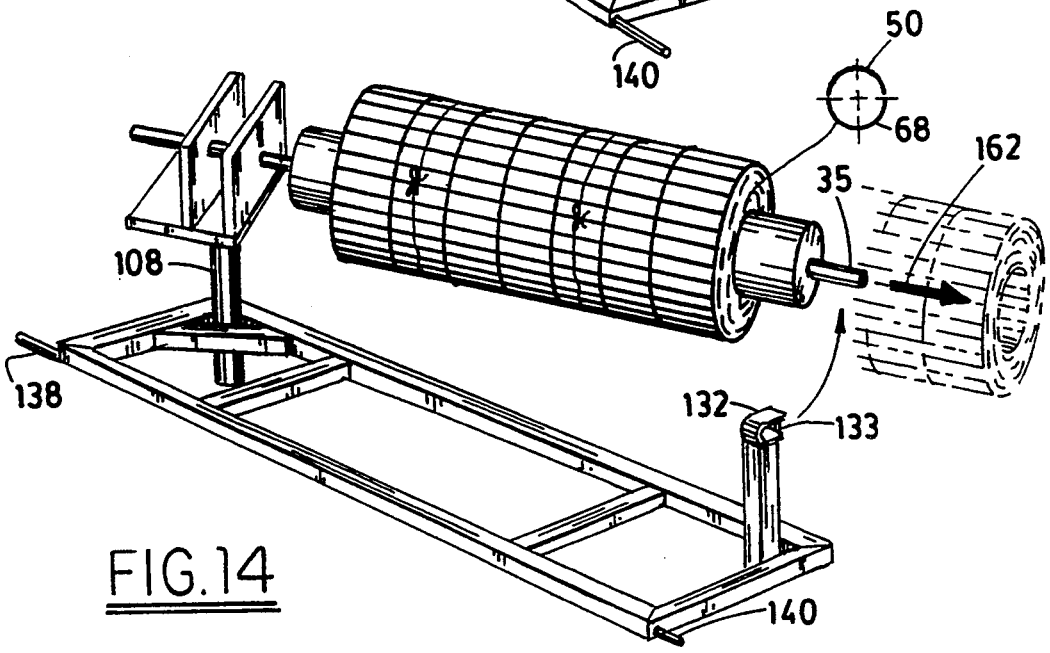
FIG. 14 is a perspective view of the apparatus of FIG. 13 after the roll has been detached from the end shaft support and moved away therefrom.

The electric motor was then started, and the fencing material was rolled up over the drum 32 (see FIGS. 13 and 14). Thereafter, the motor was stopped, locking pin 133 (see FIG. 10) was removed from the cradle 132, 26, and shaft 35 was removed from cradle 132 and rotated outwardly (see FIGS. 13 and 14).

Thereafter, handle 78 was pulled outwardly (see FIG. 6), thereby collapsing drum 32. The rolled up fencing material 156 (see FIGS. 13 and 14) was then removed from the collapsed drum.

The operation was conducted in about 25 percent of the time it took to do the same operation manually.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for winding fence material comprising a leading edge portion, wherein said apparatus is comprised of a first shaft, a fence supporting member with a substantially curvilinear shape attached to said first shaft, means for rotating said first shaft, means for removably locking said leading edge portion of said fence material within said fence supporting member and for increasing the circumference of said fence supporting member, and means for unlocking said leading edge portion of said fence material within said fence supporting member and for decreasing the circumference of said fence supporting member, wherein:

(a) said apparatus is comprised of a second shaft;

(b) said means for rotating said first shaft is comprised of a motor and a speed reducer connected to said motor;

(c) said apparatus is comprised of a base, means for disposing said first shaft above said base, and means for disposing said second shaft above said base; and (d) said apparatus is comprised of means for rotating said base.

2. The apparatus as recited in claim 1, wherein said means for rotating said first shaft is comprised of an electric motor.

3. The apparatus as recited in claim 2, wherein said electric motor is a direct current electric motor.

4. An apparatus for winding fence material comprising a leading edge portion, wherein said apparatus is comprised of a first shaft, a fence supporting member with a substantially curvilinear shape attached to said first shaft, means for rotating said first shaft at a rate of from about 20 to about 50 revolutions per minute, means for removably locking said leading edge portion of said fence material within said fence supporting member and for increasing the circumference of said fence supporting member, and means for unlocking said leading edge portion of said fence material within said fence supporting member and for decreasing the circumference of said fence supporting member, wherein:

(a) said apparatus is comprised of a second shaft, (b) said means for rotating said first shaft at a rate of from about 20 to about 50 revolutions per minute is comprised of a direct current electric motor and a speed reducer connected to said electric motor, (c) said apparatus is comprised of a base, means for disposing said first shaft above said base, and means for disposing said second shaft above said base, wherein:

(i) said means for disposing said first shaft above said base is comprised of first means for adjusting the distance between said first shaft and said base, and (ii) said means for disposing said second shaft above said base is comprised of second means for adjusting the distance between said second shaft and said base; and (d) said apparatus is comprised of means for rotating said base.

5. The apparatus as recited in claim 4, wherein said apparatus is comprised of a cradle.

6. The apparatus as recited in claim 5, wherein said apparatus is comprised of means for removably locking said second shaft within said cradle.

7. The apparatus as recited in claim 6, wherein said apparatus is comprised of a means for aligning said fence material as said first shaft is rotated.

8. The apparatus as recited in claim 7, wherein said means for removably locking said leading edge portion of said fence material is comprised of a first locking bar and a second locking bar.

9. The apparatus as recited in claim 8, wherein said first locking bar is comprised of a first orifice, and said second locking bar is comprised of a second orifice.

10. The apparatus as recited in claim 9, wherein said fence supporting member is comprised of a movable door which is adapted to move between an open position and a closed position.

11. The apparatus as recited in claim 9, wherein said apparatus is comprised of means for aligning said first and said second orifice when said movable door is in said open position.

12. The apparatus as recited in claim 11, wherein said movable door is comprised of a rod adapted to be inserted through said first orifice and said second orifice.

13. The apparatus as recited in claim 12, wherein said apparatus is comprised of means for limiting the movement of said rod.

* * * * *